US006857988B2

(12) United States Patent
Kiiski et al.

(10) Patent No.: US 6,857,988 B2
(45) Date of Patent: Feb. 22, 2005

(54) ARRANGEMENT IN CONNECTION WITH TREADMILL

(75) Inventors: Heikki Kiiski, Turku (FI); Leif Lindbom, Turku (FI)

(73) Assignee: Tunturi Oy, Ltd. (FI)

( * ) Notice: Subject to any disclaimer, the term of this patent is extended or adjusted under 35 U.S.C. 154(b) by 0 days.

(21) Appl. No.: 09/881,905

(22) Filed: Jun. 15, 2001

(65) Prior Publication Data

US 2002/0055421 A1 May 9, 2002

Related U.S. Application Data

(63) Continuation of application No. PCT/FI99/01049, filed on Dec. 16, 1999.

(30) Foreign Application Priority Data

Dec. 17, 1998 (FI) ..... 982740

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 931,394 A * 8/1909 Day ..... 482/54
2,017,128 A 10/1935 O'Neill, Jr.
3,650,529 A * 3/1972 Salm et al. ..... 482/54
4,344,616 A * 8/1982 Ogden ..... 482/54
4,759,540 A * 7/1988 Yu et al. ..... 482/54
5,733,228 A 3/1998 Stevens
5,803,874 A * 9/1998 Wilkinson ..... 482/54

* cited by examiner

*Primary Examiner*—Glenn E. Richman
(74) *Attorney, Agent, or Firm*—H. Albert Richardson; Black Lowe & Graham PLLC

(57) ABSTRACT

An arrangement in connection with a treadmill, the arrangement comprising a basic unit composed of a frame and a running track movably arranged thereon and rails arranged in connection with the basic unit. To provide a flexibly modifiable structure arrangement comprises articulation parts on both sides of the basic unit, the articulation parts being arranged to be fastened to first points of the rails on both sides of the basic unit. A supporting rack extending in the longitudinal direction of the basic unit is arranged to the articulation parts, the supporting rack being arranged to be fastened from its free end to second points of the rails on both sides of the basic unit.

11 Claims, 4 Drawing Sheets

ARRANGEMENT IN CONNECTION WITH TREADMILL

This application is a continuation of international application number PCT FI99/01049, filed on Dec. 16, 1999.

The invention relates to an arrangement in connection with a treadmill, the arrangement comprising a basic unit composed of a frame and a running track movably arranged thereon and rails arranged in connection with the basic unit, whereby the arrangement comprises articulation parts on both sides of the basic unit, the articulation parts being arranged to be fastened to first points of the rails on both sides of the basic unit, and a supporting rack extending in the longitudinal direction of the basic unit, the supporting rack being arranged to the articulation parts and being arranged to be fastened from its free end to second points of the rails on both sides of the basic unit.

Nowadays, such arrangements are very common in connection with different treadmill solutions. In practice, the previously known solutions run quite smoothly. However, a drawback is that models vary according to a device type. It was the idea originally to provide non-folding treadmill structures do not allow the basic unit to be folded up, for example for storage, and folding treadmills whose basic unit can be folded up for storage, for example.

The above division has led to a situation in which treadmill structures differ from one another so widely that in practice it is impossible to convert a non-folding treadmill into a folding treadmill. The dissimilarity between the structures has also led to a situation in which the number of different parts to be made and stocked has increased, which, in turn, increases costs.

An object of the invention is to provide a treadmill by which the drawbacks of the previously known solutions can be eliminated, i.e. to provide a treadmill of the type which can be realized both as foldable and non-foldable in a simple manner. This is achieved by the arrangement of the invention. The arrangement of the invention is characterized in that the supporting rack is formed detachable and that the second points of the rails are arranged to be fastened to the basic unit.

It is an advantage of the invention that a conventional non-folding treadmill can be made into a single-folding treadmill in an easy and simple manner. Since the structure can be modified very rapidly, the conversion can even be accomplished at the final location of the device. It is a further advantage of the invention that the number of different parts to be made and stocked is reduced, because both a folding treadmill and a non-folding treadmill are formed of two identical basic modules, i.e. a basic unit, and rails. A further advantage of the invention is its simplicity which allows the invention to be advantageously put into use.

In the following, the invention will be described in more detail by means of exemplary embodiments with reference to the accompanying drawings, in which FIG. 1 is a perspective view of a non-folding treadmill in the operating position and formed according to the essential idea of the invention, FIG. 2 schematically shows the arrangement of the invention, FIG. 3 shows a detail of the solution of FIG. 2, FIG. 4 shows the treadmill of FIG. 1 in the operating position and converted into a folding model with the help of the arrangement of FIG. 2, FIG. 5 is a side view of the treadmill of FIG. 4 when the treadmill is folded up in the storage position, and FIG. 6 is the case of FIG. 5 seen from a different direction.

FIG. 1 is a perspective view of a non-folding treadmill in the operating position and formed according to the basic idea of the invention. FIG. 1 shows the treadmill in the normal operating position. In FIG. 1, a basic unit of the treadmill is generally referred to by reference number 1. The basic unit comprises a frame 2 and a running track 3 arranged thereon and other units such as a motor and other necessary fittings.

In FIG. 1, rails arranged in connection with the basic unit 1 are generally denoted by reference number 4.

The structure, details and operation of the basic unit 1 of the treadmill are fully conventional technique for those skilled in the art, and therefore not described here in more detail.

FIG. 2 schematically shows an arrangement according to the arrangement of the invention. The arrangement of the invention comprises articulation parts 5 on both sides of the basic unit. The articulation parts 5 are arranged to be fastened to first points of the rails 4 on both sides of the basic unit 1. A supporting rack 7 extending in the longitudinal direction of the basic unit 1 is arranged to the articulation parts 5, the supporting rack being arranged to be fastened from its free end to second points of the rails 4 on both sides of the basic unit. In FIG. 2, the fastening of the supporting rack to the second points of the rails is indicated, by reference number 8. In the embodiment of FIG. 2 the articulation parts 5 are interconnected by a transverse articulated shaft 6. The articulation parts can also be connected to the basic unit with suitable connection pieces, for instance.

FIG. 4 shows the treadmill in the operating position, and FIGS. 5 and 6 show the same treadmill folded up in the storage position.

Figure 1:
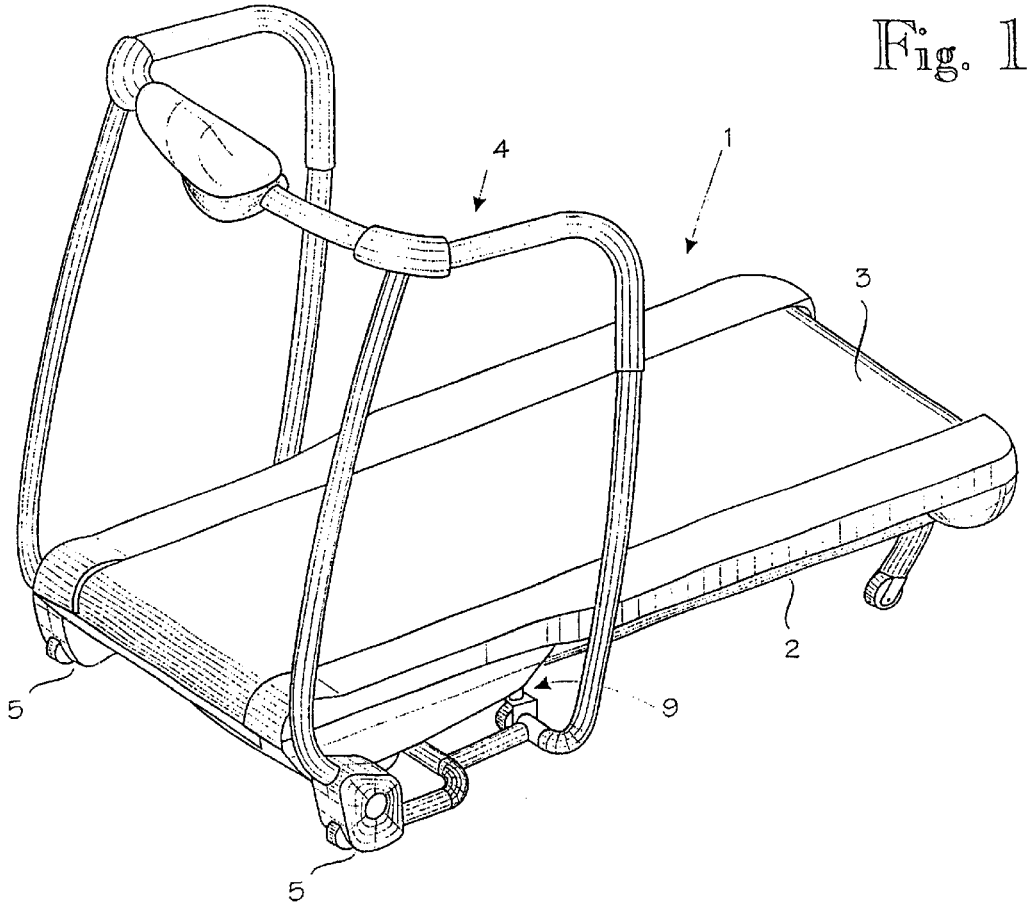
Figure 2:
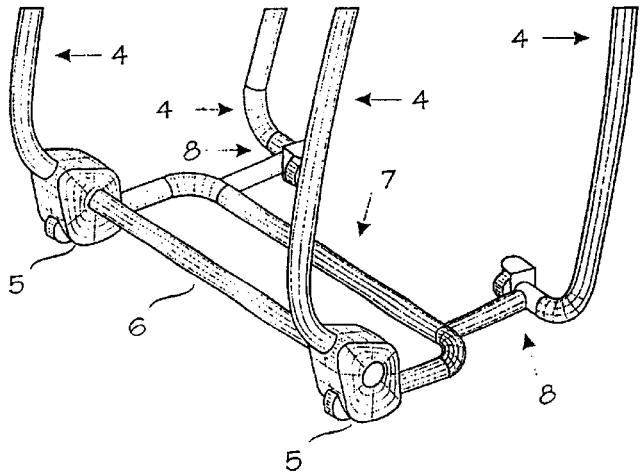
Figure 3:
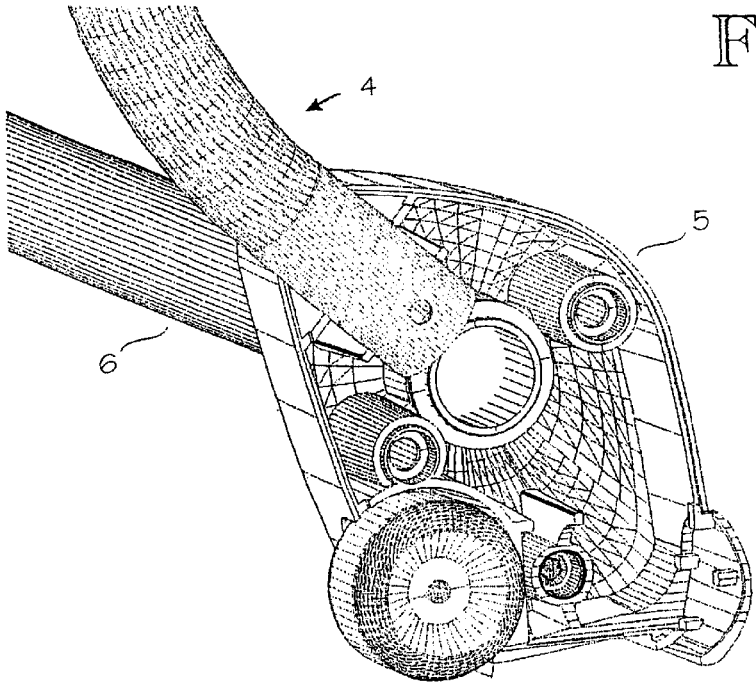
FIG. 3 shows a larger-scale sectional view of a detail of the structure, i.e. the articulation part 5, presented in FIG. 2.

As can be seen from the above FIGS. 2 to 6, the rails are fastened at first points to the articulation parts 5 and at second points to the supporting rack 7. Thanks to the above-described solution, the basic unit 1 can be folded up from the operating position according to FIG. 4 to the storage position according to FIGS. 5 and 6. The basic unit turns around the articulated shaft 6 as shown in the figures.

In accordance with the essential idea of the invention, a folding treadmill can be converted into a non-folding treadmill, and vice versa, in a simple manner.

The folding treadmill presented in FIGS. 4 to 6 can be converted into a non-folding treadmill, shown in FIG. 1, in the following manner. The supporting rack 7 can be made detachable, whereby it can be detached from the articulation parts 5, if desired. In that case the supporting rack is also detached from the second points of the rails. Next, the second points of the rails are fastened to the basic unit 1 with adapter parts 9, for example, leading to the non-folding treadmill of FIG. 1.

Figure 4:
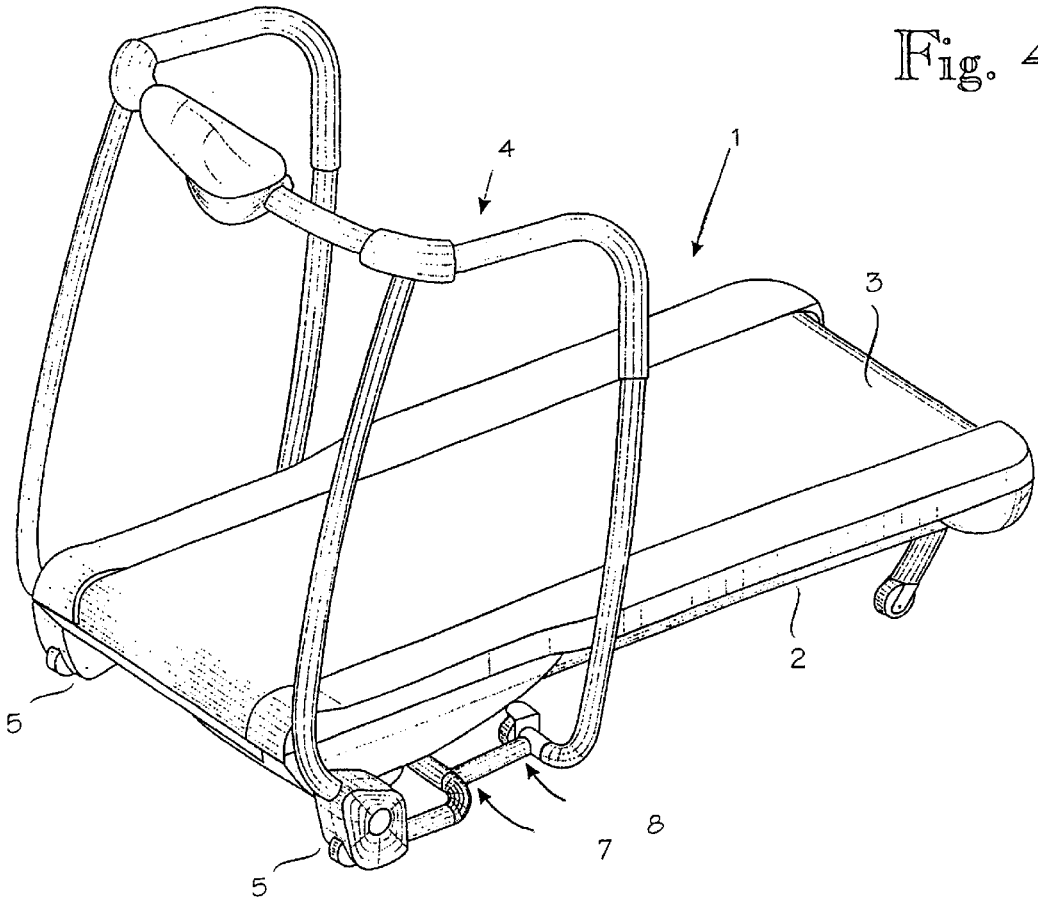
FIGS. 4 to 6 show a treadmill applying the arrangement of FIG. 2.
Figure 5:
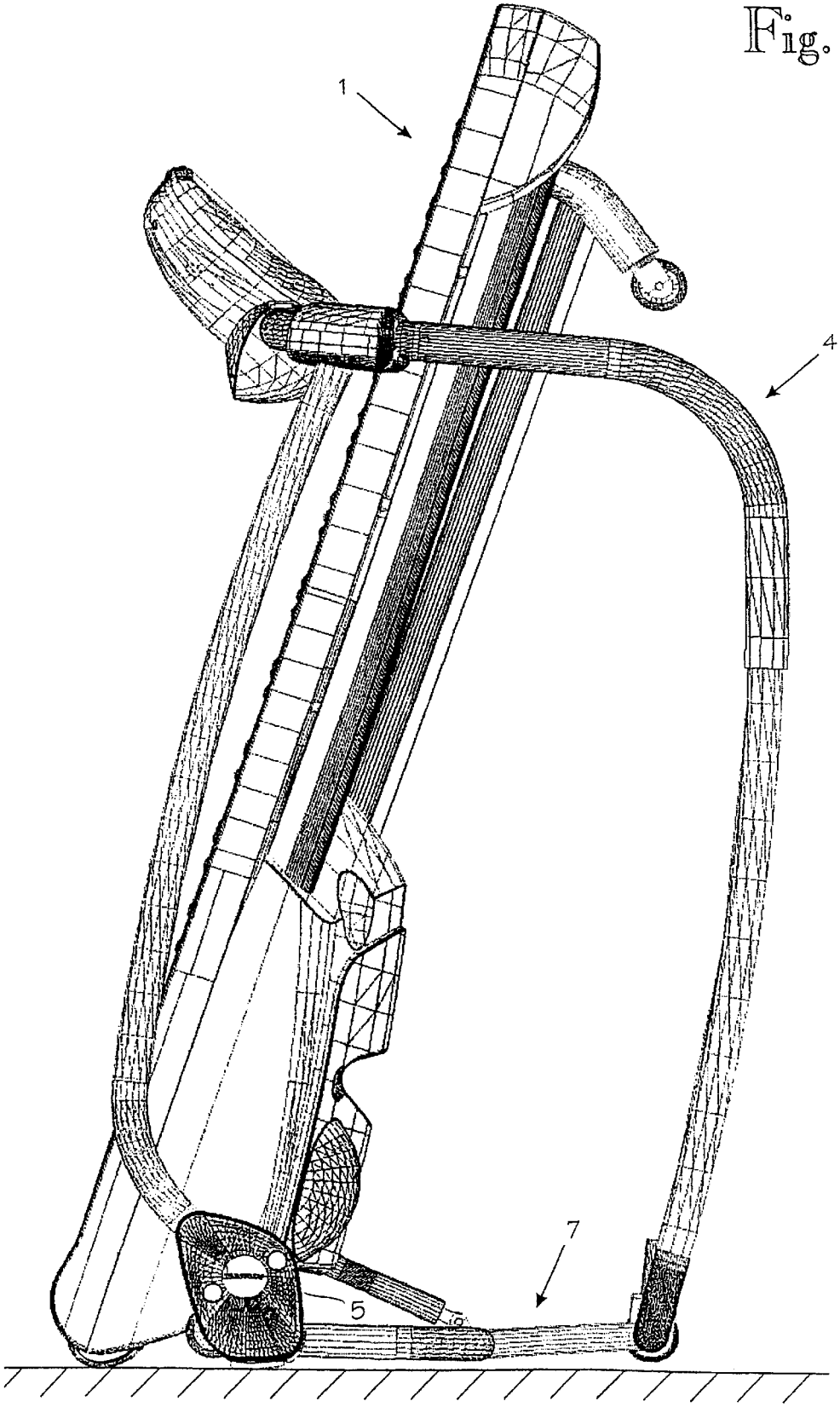
Figure 6:
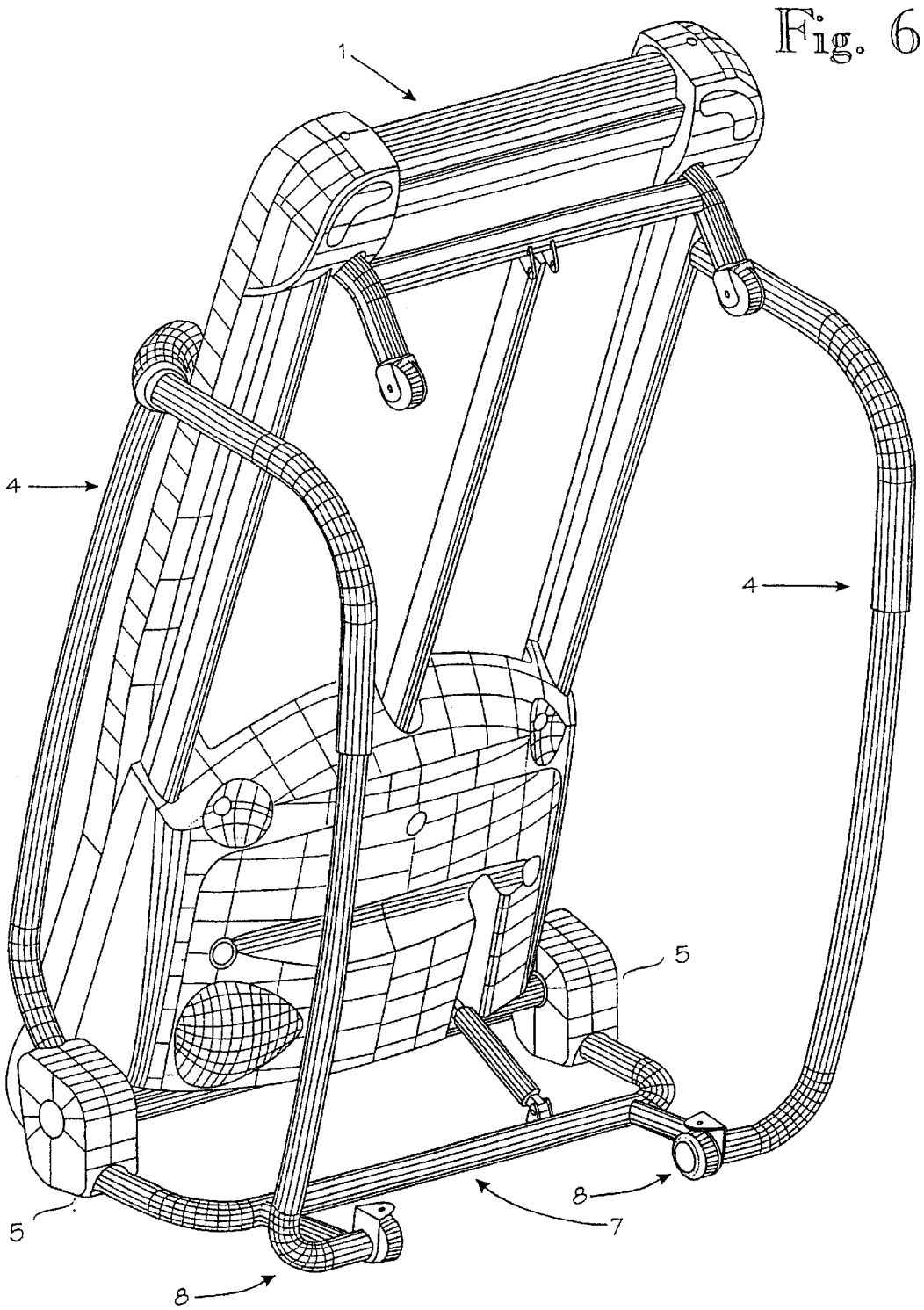

The non-folding treadmill of FIG. 1 can be converted into the folding treadmill of FIGS. 4 to 6 by detaching the connections between the second points of the rails and the basic unit 1, removing the adapter parts 9 and connecting the supporting rack 7 to the articulation parts and to the second points of the rails.

It is to be noted that the above conversion can be accomplished in a very simple and fast manner. The conversion can even be accomplished at the customer after it has been worked out at the operating site of the device which solution is in practice more advantageous. The above conversions can also be very advantageously accomplished when the location of the treadmill changes, or when the space that is used changes. In other words, the same basic device can be converted into different types of devices very rapidly according to a customer's demands and a situation at a given time.

The above exemplary embodiments are by no means intended to restrict the invention, but the invention can be completely freely modified within the scope of the claims. It is therefore obvious that the arrangement and details of the invention, or the running track utilizing the invention, do not need to restrict to the figures, but other solutions are also possible. Consequently, it is obvious that the various components of the arrangement of the invention can be designed to be different from the ones presented in the figures. The articulation parts can be provided with transportation rolls as shown in the figures, but this is not essential; within the scope of the invention it is also possible to form the articulation parts without any rolls, in case such a solution is considered necessary. The invention can be applied in connection with a motorized running track, non-motorized running track, and so on.

What is claimed is:

1. A treadmill arrangement convertible from a non-foldable type to a foldable type, the arrangement comprising:

a basic unit including a frame having opposing sides and a running track;

a rail assembly pivotally mounted to the basic unit for rotation about a transverse axis, the rail assembly including two pairs of rails, each pair having a forward rail and an aft rail and being detachably connected to the frame at two points on opposing sides thereof and aft of the axis; and a support rack detachably mountable to the aft rails.

2. The treadmill assembly of claim 1 further including a transverse articulated shaft extending between the forward rails.

3. The treadmill assembly of claim 2 wherein the articulated shaft is mounted for rotation on the rail assembly.

4. A treadmill arrangement convertible from a non-foldable to a foldable type, the arrangement comprising:

a basic unit including a frame having opposing sides and a running track;

a rail assembly pivotally mounted to the basic unit for rotation about a transverse axis, the assembly including a pair of spaced articulation units, two pairs of rails disposed on opposing sides of the frame, each pair including a forward rail and an aft rail, each forward rail being connected to one of the articulation units and the aft rails being detachably connected to the opposing sides of the frame aft of the axis; and support rack mounted to the articulation units and to each of the aft rails.

5. The treadmill arrangement of claim 4 wherein the support rack is detachably mounted to the articulation units and to each of the aft rails.

6. The treadmill assembly of claim 4 wherein the rail assembly further includes a transverse articulated shaft mounted to each of the articulation units.

7. The treadmill assembly of claim 6 wherein the articulated shaft is rotatably mounted to the articulation units.

8. The treadmill assembly of claim 6 wherein the articulated shaft is mounted to the basic unit.

9. The treadmill assembly of claim 6 the articulated shaft is rotatably mounted to the basic unit.

10. The treadmill assembly of claim 4 wherein the articulation units are disposed on opposing sides of the frame.

11. A treadmill arrangement convertible from a non-foldable type to a foldable type, the arrangement comprising:

a basic unit including a frame having opposing sides and a running track; and a rail assembly including a pair of spaced articulation units disposed on opposing sides of the frame, two pairs of rails disposed on opposing sides of the frame, each pair including a forward rail and an aft rail, each forward rail being connected to one of the articulation units and the aft rails being detachably mounted to the frame on opposing sides thereof and aft of the axis, a support rack detachably mounted to each of the articulation units and to each of the aft rails, and a transverse articulated shaft mounted to the basic unit and rotatably mounted to the articulation unit.

* * * * *